United States Patent [19]

Schulthess

[11] 4,443,974

[45] Apr. 24, 1984

[54] DOOR HAVING A FRAME COMPRISING SECTIONS GLUED TO EACH OTHER

[75] Inventor: Hans Schulthess, Klingnau, Switzerland

[73] Assignee: Keller & Co., Aktiengesellschaft, Klingnau, Switzerland

[21] Appl. No.: 354,257

[22] Filed: Mar. 2, 1982

[30] Foreign Application Priority Data

Mar. 6, 1981 [CH] Switzerland ..... 1569/81

[51] Int. Cl.[3] ..... E06B 1/04

[52] U.S. Cl. ..... 49/505; 49/504; 52/212; 52/213; 52/217

[58] Field of Search ..... 52/211, 212, 213, 217, 52/144; 49/504, 505, 501

[56] References Cited

U.S. PATENT DOCUMENTS

| | | | |
|---|---|---|---|
| 2,492,771 | 2/1970 | Jones et al. | 52/144 X |
| 2,706,315 | 4/1955 | Price | 52/144 X |
| 2,736,930 | 3/1956 | Longley | 52/217 X |
| 2,997,750 | 8/1961 | Lester, Sr. | 52/212 |
| 3,964,214 | 6/1976 | Wendt | 49/504 X |
| 4,307,543 | 12/1981 | Schulthess | 49/504 X |

FOREIGN PATENT DOCUMENTS

| | | | |
|---|---|---|---|
| 432791 | 9/1967 | Switzerland | 49/504 |

*Primary Examiner*—Kenneth Downey

*Attorney, Agent, or Firm*—Karl W. Flocks; A. Fred Starobin; Sheridan Neimark

[57] ABSTRACT

The frame shim comprises a first and a second elongated plate made of a porous material, which plates are located in planes extending parallel to each other and which are connected to each other along their longitudinal sides. A groove is formed in one longitudinal side of one of the plates, and a laterally located ridge is formed in a longitudinal side of the other plate, which ridge is set into the groove. The other longitudinal side of the laterally offset plate is strengthened and the door fittings are mounted to this longitudinal side. The legs of the groove are also strengthened. This allows the manufacture of the frame shim of a door from a plate made of a porous material.

8 Claims, 1 Drawing Figure

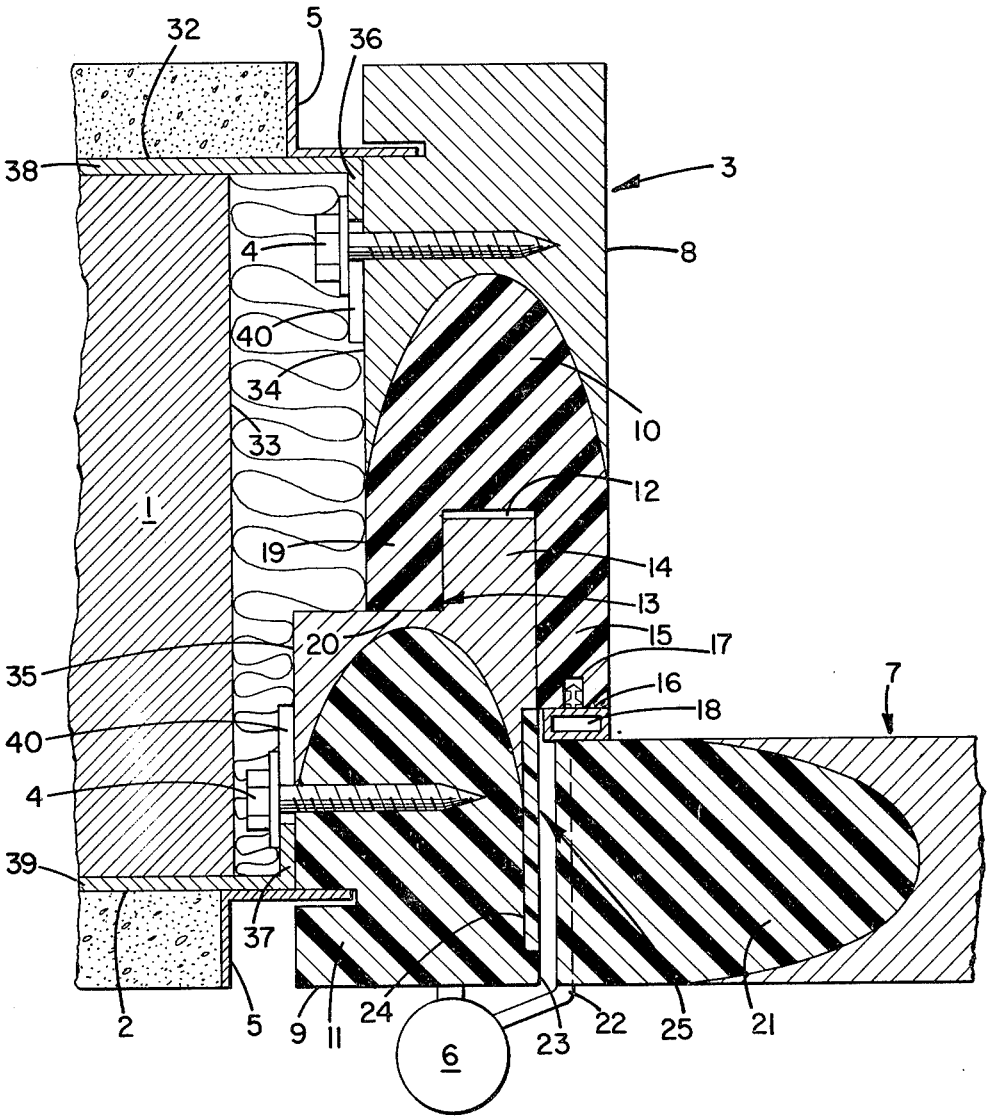
32
5
36
38
3
4
8
40
34
10
33
12
1
19
14
13
20
15
17
35
16
7
18
40
4
39
37
2
5
9
11
24
23
22
25
21
6

DOOR HAVING A FRAME COMPRISING SECTIONS GLUED TO EACH OTHER

BACKGROUND OF THE INVENTION

1. Field of the Invention

The present invention relates to a door having a frame which comprises sections which are glued to each other. The invention relates also to a method of manufacturing a door having a frame which comprises sections which are glued to each other, and in which the frame shim of the door comprises these sections, which sections are elongated plates made of a porous material and are located in planes extending parallel to each other, which plates have longitudinally extending sides which are mounted to each other by means of a keyway-like connection.

2. Description of the Prior Art

Known doors are provided with door frames having a U-shaped cross section, whereby the two legs define the lining placed on the two oppositely located side surfaces of the wall and the base of the U which is placed at the face surface of the wall defining the door opening forms the so-called frame shim. The two legs defining the lining are connected to the base of the U defining the frame shim by means of a keyway-like connection. These elongated door frame parts are connected to each other by the agency of a glue. The lining as well as the frame shim are thereby manufactured of naturally grown wood.

As mentioned immediately above naturally grown wood is used for the manufacture of such door frames. Also in case of using oak wood such door frame is hardly fireproof such that a door frame manufactured accordingly may not meet the fireproof standards which are becoming ever increasingly stricter. Furthermore, naturally grown wood is usually rather expensive.

SUMMARY OF THE INVENTION

Hence, it is a first object of the present invention to provide a door which has a door frame which can be manufactured at less cost. A further object of the present invention is to construct the door frame such that it is more resistent to fire in comparison with comparable door frames made of wood in spite of the lower cost of manufacture, which door frame is such, that the door fittings such as, for instance, parts of the hinges can be securely mounted thereto.

The above and other objects which will become more apparent as the description proceeds will be attained by a door which is manifested by the features that the frame shim of the door comprises mentioned sections and wherein these sections are elongated plates made of a porous material, which sections are located in planes extending parallel to each other, and in which the longitudinally extending sides of said plates are mounted to each other by means of a keyway-like connection.

A method of manufacturing such door is manifested by the steps of treating one plate made of a porous material such that at least its oppositely located edge areas are strengthened; of cutting said treated plate between said two oppositely located edge areas; of providing the strengthened edge area of one of such elongated plates with a groove and providing the not strengthened edge area of the other elongated plate with a fold; and of inserting the ridge formed by the folding of said not strengthened edge area into said groove.

BRIEF DESCRIPTION OF THE DRAWINGS

The invention will now be described by making reference to the annexed drawing in which the single FIGURE shows a horizontal section of a part of the inventive door.

DETAILED DESCRIPTION OF THE PREFERRED EMBODIMENT

The masonry or brickwork, respectively, which has an opening, in which the door including its frame is to be inserted, is identified by the reference numeral 1. The opening in the masonry 1 is provided with wall angle pieces 2, 32, to which the frame shim 3 of the door is mounted by the agency of screw bolts 4. The transition between mentioned wall angles 2, 32 and the frame shim 3 is covered by means of profile bars 5. The free space between the masonry 1 and the frame shim 3 is filled by stone wool.

The frame shim 3, of which only such part is shown in the drawing in a horizontal section, and in which the pivots 6 of the hinge of the door panel 7 are inserted to, comprises a first elongated plate 8 and a second elongated plate 9, both made of a porous material. These plates 8 and 9 may be manufactured, for instance, of wood chip board. The cross hatched areas 10 and 11 in the plates 8 and 9 are areas of these plates 8 and 9 which are strengthened. This strengthening of the narrow longitudinal sides of the plates 8 and 9 is achieved in that a strengthening agent, for instance, a resin, water glass or similar, is pressed into the narrow sides or edges, respectively, of the respective plates 8 and 9. Such a method is, for instance, disclosed in the CH-PS No. 577 378. The impact strength of such treated narrow sides of porous plates is considerably increased, and it is possible to screw screw bolts into the narrow side of such boards.

It has been mentioned above that one of the main problems of a door frame made of a porous plate is the formation of a limit stop for the door panel. This problem has now been solved, in that the stengthened longitudinal side of the first plate 8 is provided with a groove 12, and in that a fold 13 is shaped in the not strengthened length side of the second plate 9. Section 14, which projects after the shaping of this fold from the remaining portion of the second elongated plate, defines a longitudinal peg or ridge, respectively, of which the width can be chosen such that the ridge fits into groove 12. This ridge 14 may then be bonded in the groove 12 by means of a suitable bonding agent, a suitable glue.

Because one of the flanks of the ridge 14 is aligned with one of the sides of the second plate 9, and because groove 12 is located roughly in the middle of the first plate 8, one of the legs 15 of the groove projects from the above mentioned surface of the second plate 9. Accordingly, the plates 8 and 9 are located in two planes extending parallel relative to each other.

The face surface 16 of the last named leg 15 of the groove forms together with the surface area 23 of the second plate 2, which is not covered by the leg 15 of the groove, a fold whereby a part of the edge area of the door panel 7 will be located into this fold when the door is in its closed position. The face 16 of mentioned leg of the groove acts accordingly as limit stop for the door panel 7. In order to provide the necessary sealing of the door, the leg 15 of the groove is provided with a deep groove 17, into which groove 17 a sealing member 18 is inserted. Because leg 15 of the groove is made of a strengthened material portion, it may be relatively narrow and features in spite of this the necessary impact strength against the impact of the door panel. Thereby, the deep groove 17 may be even formed in this leg 15 of the groove without detrimentally influencing the strength of the leg 15.

In the shown embodiment the other leg 19 of the groove is made shorter than the first mentioned leg 15. It is, however, to be understood, that both legs 15 and 19 of the groove may comprise the same length.

The depth of engagement of the ridge 14 into groove 12 may be preferably defined by the laterally extending shoulder 20 of the fold 13, which is located oppositely of the second leg 19 of the groove. In the mounted condition this shoulder 20 abuts the face of the second leg 19 of the groove.

As may be clearly seen from the drawing, one end of the pivot 6 of the hinges are inserted in the strengthened area 11 of the second elongated plate 9 at the one end, whereby the other legs 22 of these hinges 6 are mounted to the also strengthened edge section 21 of the door panel. It is obvious that the second elongated plate 9 comprises also at the oppositely located vertically extending portion (not shown) of the frame shim 3 the strengthened area 11. The closing strip (not shown) of the door panel may be inserted into the inner surface 23 of such a second plate 9, whereby below thereof the corresponding recesses may also be made in the strengthened area 11.

A strip 24 of a material which foams at increased temperature is inserted along the complete frame shim 3 of the door into mentioned inner surface 23 of the second elongated plate 9. Such material is, for instance, known by the trademark Palusol. In case of a fire, the foam generated thereby fills completely the slit 25 between the door frame shim 3 and the door panel 7 such that this slit 25 seals against smoke and fire. This strip 24 of a foamable material may be provided at both sides with a strip of a plastic material or of aluminium. Such strips protect the material strip 24 against a damaging and against moisture.

The present invention relates also to a method of manufacturing above described door, specifically of manufacturing the door frame shim 3. In order to manufacture the corresponding part of the door frame shim 3 an elongated plate made of a porous material is provided, for instance, a wood chip board, and the edge areas of such board are strengthened by treating them by means of a suitable resin or similar material. Thereafter, such elongated plate is cut along its longitudinal direction such that the two elongated plates 8 and 9 are shaped. Both plates 8 and 9 comprise an edge area 10 or 11, respectively, which are strengthened as well as an edge area which is not strengthened. The groove 12 is then shaped in the strengthened edge area 10 of the first plate 8. Thereby the two legs 15, 19 of such groove 12 may be of the same length. In the preferred embodiment shown in the drawing the second leg 19 is shorter than the first leg 15.

The fold 13 is formed in the not strengthened edge area of the second elongated plate 9 whereby the remaining section and now projecting section of the not strengthened edge area defines a longitudinal peg or ridge 14, respectively. The plates 8, 9 are thereafter arranged such relative to each other that the ridge 14 can be inserted into groove 12. Accordingly, the frame shim 3 as shown in the drawing is shaped, which frame shim 3 can now be manufactured out of a porous material and which meets all demands made for a door frame.

It may sometimes be necessary to provide also the other longitudinal side of the first elongated plate with an increased strength. In such case the first elongated plate 8 must be treated itself such that it comprises strengthened areas at both its sides. The same proves true for the second elongated plate 9.

As mentioned above, plates 8 and 9 which are mounted to the masonry 1 by means of the wall angle pieces 2, 32 extend in parallel planes. This leads now to the fact, that the surface areas 34, 35 of the plates 8, 9 facing the surface area 33 of the opening in the masonry 1 are at various distances from the surface area 33 of the opening in the building wall 1. In order to compensate these differing distances the first legs 36, 37 of the wall angle pieces 2, 32, which are abutted by the plates 8, 9 in different distances from the surface area 33 of the wall. It is possible to achieve this by providing the two legs 38, 39 of the wall angle pieces 2, 32 with different lengths. The first legs 36, 37 are provided with elongated slots 40, into which the screw bolts 4 are inserted, which may be wood screw bolts.

While there is shown and described a preferred embodiment of the present invention, it is to be distinctly understood that such is intended for illustration only, and that various modifications thereof may be made within the scope of the following claims.

ACCORDINGLY,

What is claimed is:

1. A fire resistant door having a frame with said frame comprising a frame shim including sections of elongated plates of a porous material which are glued together, said plate sections located in planes extending parallel to each other and mounted to each other at their longitudinal extending sides by means of a keyway-like connection with a first longitudinal side of one of said plates having a groove and a second longitudinal side of the other of said plates having a ridge fitted into said groove, said first longitudinal side of one of said plates having said groove in a portion of said porous material strengthened by pressed in water glass, said second longitudinal side of the other of said plates having said ridge having another side of said plate from said ridge strengthened by pressed in water glass, a strip of material which foams at an increased temperature arranged in the surface of said other of said elongated plates where said surface faces a panel of the door, and a strip of aluminum on both sides of said strip of material which foams at an increased temperature.

2. The door of claim 1, wherein said other plate comprises a fold, and wherein the projecting portion of said other plate forms said ridge such that the laterally extending shoulder of said fold is located opposite of one of the two legs of said groove.

3. The door of claim 2, wherein the leg of said groove which is located opposite of said laterally extending shoulder is shorter than the other leg of said groove.

4. The door of claim 2, wherein the face of said other leg of said groove acts as limit stop for the door panel.

5. The door of claim 4, wherein the face of said other leg of said groove is provided with a seal.

6. The door of claim 1, wherein the strengthened longitudinal side of said other plate is provided with door fittings.

7. The door of claim 1, wherein said plates are mounted to masonry by the agency of wall angle pieces.

8. A method of manufacturing a door having a frame which comprises sections which are glued to each other and in which the frame shim of said door comprises said sections, which said sections are elongated plates made of a porous material and are located in planes extending parallel to each other, which said plates have longitudinally extending sides which are mounted to each other by means of a keyway-like connection, comprising the steps of treating one plate made of a porous material such that at least its oppositely located edge areas are strengthened; of cutting said treated plate between said two oppositely located edge areas; of providing the stengthened edge area of one of such elongated plates with a groove and providing the not strengthened edge area of the other elongated plate with a fold; and of inserting the ridge formed by the folding of said not strengthened edge area into said groove.

* * * * *